US008979423B2

(12) United States Patent
Smieja

(10) Patent No.: US 8,979,423 B2
(45) Date of Patent: Mar. 17, 2015

(54) AUTOMATIC MATERIAL HEIGHT SENSOR FOR ASPHALT PAVERS

(71) Applicant: Caterpillar Paving Products Inc., Brooklyn Park, MN (US)

(72) Inventor: Jameson Michael Smieja, Mound, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 120 days.

(21) Appl. No.: 13/648,952

(22) Filed: Oct. 10, 2012

(65) Prior Publication Data

US 2014/0099165 A1 Apr. 10, 2014

(51) Int. Cl.

| | |
|---|---|
| ***E01C 23/07*** | (2006.01) |
| ***E01C 3/06*** | (2006.01) |
| ***E01C 19/48*** | (2006.01) |

(52) U.S. Cl.

CPC ..... *E01C 19/48* (2013.01)
USPC ..... 404/84.05; 404/72

(58) Field of Classification Search

USPC ..... 404/84.05, 84.1, 84.5, 72
See application file for complete search history.

(56) References Cited

U.S. PATENT DOCUMENTS

| | | | | |
|---|---|---|---|---|
| 3,678,817 | A | 7/1972 | Martenson et al. | |
| 3,967,912 | A * | 7/1976 | Parker | 404/84.05 |
| 4,012,160 | A | 3/1977 | Parker | |
| 4,823,366 | A | 4/1989 | Williams | |
| 4,933,853 | A * | 6/1990 | Musil et al. | 701/50 |
| 5,201,604 | A * | 4/1993 | Ferguson et al. | 404/110 |
| 5,258,961 | A * | 11/1993 | Sehr et al. | 367/96 |
| 5,452,966 | A * | 9/1995 | Swisher, Jr. | 404/72 |
| 5,575,583 | A | 11/1996 | Grembowicz et al. | |
| 5,588,776 | A | 12/1996 | Swisher, Jr. et al. | |
| 7,172,363 | B2 * | 2/2007 | Olson et al. | 404/75 |
| 7,856,302 | B2 * | 12/2010 | Rasmussen | 701/50 |
| 8,070,385 | B2 * | 12/2011 | Green | 404/84.5 |
| 2002/0110419 | A1 * | 8/2002 | Batty et al. | 404/84.1 |
| 2006/0045620 | A1 * | 3/2006 | Olson et al. | 404/84.1 |
| 2013/0223927 | A1 * | 8/2013 | Mings et al. | 404/72 |

FOREIGN PATENT DOCUMENTS

| | | |
|---|---|---|
| CA | 1302144 | 6/1992 |

* cited by examiner

*Primary Examiner* — Abigail A Risic

(74) *Attorney, Agent, or Firm* — BakerHostetler

(57) ABSTRACT

A method and apparatus is disclosed for controlling material feed for asphalt pavers. The material feed system includes a screed, feeder conveyor and a spreader auger. A sensor measures a material volume and transmits this information to an electronic control module (ECM). This information may be used as the target material volume, which the ECM may use to calculate a corresponding conveyor speed and auger speed. The sensor monitors the material volume as paving commences, and the ECM maintains the initial calibrated target size by adjusting the auger and conveyor rotational speeds.

7 Claims, 4 Drawing Sheets

AUTOMATIC MATERIAL HEIGHT SENSOR FOR ASPHALT PAVERS

TECHNICAL FIELD

The present disclosure provides examples in the field of semi-automation and/or automation of machines, in particular, asphalt pavers.

BACKGROUND

Asphalt road paving machines (or asphalt pavers) include a tractor with a hopper for receiving asphalt paving material located at the front of the paver, and a feeder conveyor for delivering the asphalt paving material to the rear of the paver to a spreader auger. The auger distributes the asphalt laterally behind the tractor to the road surface in front of the screed.

Asphalt pavers include a screed, a heavy assembly drawn behind the paving machine by a pair of pivotally mounted tow arms for smoothing out and compressing the asphalt material. Pavers may include a screed extender frame for adjusting screed width, which may be hydraulically adjustable.

Road mat thickness is determined in part by asphalt material composition, machine specifics, as well as by the volume of the asphalt material pile placed in front of the screed. Asphalt material composition and screed specifics are typically constants with a specific machine and mix; however, the height of the material pile must be continuously provided by the conveyor and auger as the paver moves forward. Material pile height should remain constant to pave an even surface. Variables affecting a current material pile size include the conveyor speed, and the auger speed.

Sensors mounted on the end of the screed or screed extender help determine the amount of material in front of the screed. The machine operator may manually set estimated material height, or provide an estimated control gain by using a marked dial or digital input on the control panel, to direct the machine to regulate the material pile to a target size using the auger and conveyor systems.

Too much material placed in front of the screed results in a ridge once the machine is adjusted to the proper material pile height. Too little material placed in front of the screed results in a dip once the machine is adjusted to the proper material pile height. Some paving machines utilize manual knobs that an operator turns to adjust the gain for a paver to set the target material pile height. This gain signals to an electronic control module (ECM) as to the material height setting, and thus, the conveyor and auger speed.

U.S. Pat. No. 5,575,583 to Grembowicz et al. describes an apparatus for controlling a material feed system. The apparatus includes a sensor that monitors the amount of material at the edge of the screed and responsively produces a target material height signal, which the operator matches using a rotary switch. It is desirable to provide a system that can provide the proper settings from initial paving. It may also be desirable to automate the process to reduce variability due to operator subjectivity.

SUMMARY

The present disclosure generally relates to automating material feed for a paver to maintain a material pile size.

In a first embodiment, the paver includes a system for regulating material feed including a screed, a conveyor and an auger. One sensor, or a pair of sensors on the screed measures the amount of material placed in front of the asphalt screed. These sensors may be contact based, sonic based, or may employ another technology. The sensors measure the size of the material pile in front of the screed, and for example, slightly beyond the auger width.

A sensor measures the initial distance from its position to the feed material adjacent the screed, and transmit this information to an ECM. The ECM uses this initial distance information to calibrate the paver by setting a target pile size to determine a conveyor and auger speed. As the paver and material feed system operates, the sensor continues to monitor the pile, and the ECM continues to determine, set, and adjust a rotational conveyor speed and a rotational auger speed to maintain the target pile size.

Upon paver initialization, the ECM transmits this auger speed, and conveyor speed, which may be determined by a ratio of the auger speed, to the auger control and the conveyor control. An algorithm within the ECM calculates information such as gains necessary to maintain the pile size, using feedback information provided by the sensor. The calibration and paving process may be initiated with a signal, which may be produced from a button, switch, or upon machine initialization, which signals the ECM to receive the target pile size input from the sensor. The step of guessing a material height or gain with a variable dial may be eliminated. Upon the start of paving, the ECM will compare the current pile size to the target pile size to control the rotational conveyor speed and the rotational auger speed ratio to maintain the target pile size. This auto-calibration option may replace, or be present in addition to manual dials.

A sensor produces a first target material height signal indicative of an initial material height at the edge of the screed, and transmit this signal to an ECM. The ECM calculates or sets a gain corresponding to the target material height. As the paver moves and material is delivered by the conveyor and auger, the sensors continue to detect an actual material height at the edge of the screed. This signal is transmitted to the ECM, which compares the actual and target material height signals, and determines a target rotational speed of the auger and conveyor to maintain the target material height.

The paver continuously senses and transmits the material pile height information to the ECM, which adjusts the auger and conveyor speeds accordingly. A machine which has been auto-calibrated may begin paving with the proper speeds and speed ratio.

The feed conveyors and spreader augers may be mechanically or electronically coupled together, and accordingly, the rotational speed may be expressed by a ratio between the conveyor rotations per minute (RPM) and the auger RPM. In an alternate embodiment, a second pair of sensors measures the amount of material deposited by the conveyor to the auger. When sensors are employed to detect the amount of material delivered by the conveyor to the auger, the conveyor speed is be independent of the auger speed.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

In the drawings.

DETAILED DESCRIPTION

Figure 1:
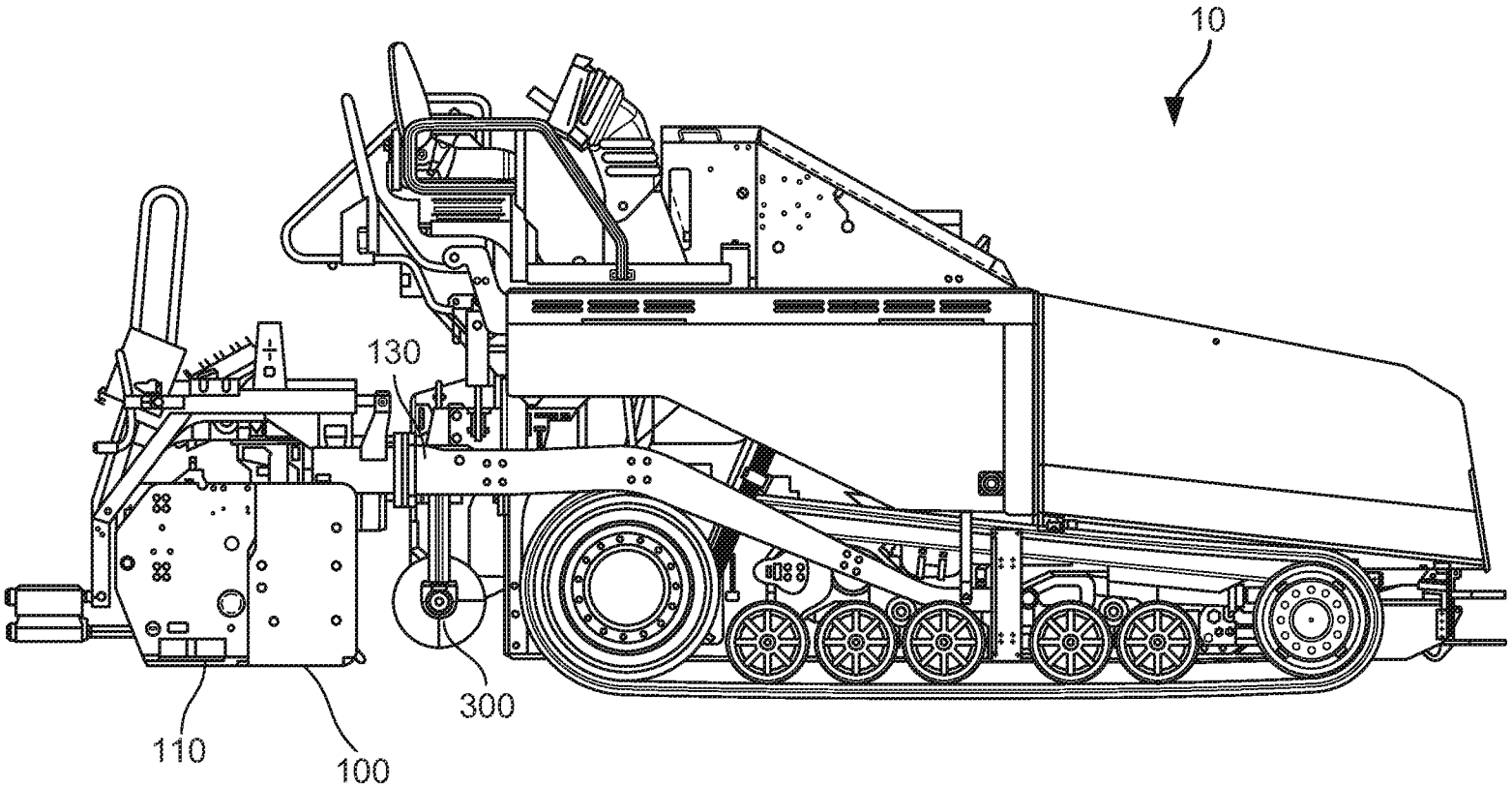
FIG. 1 is a side view, showing the general construction of an asphalt paving machine including an example apparatus of the present disclosure.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, may be arranged, substituted, combined, and designed in a wide variety of different configurations, all of which are explicitly contemplated and make part of this disclosure.

The present disclosure relates to apparatus and methods of calibrating an initial or target pile size, and maintaining that pile size. The present disclosure contemplates using sensors, e.g. paddle, acoustic, ultrasonic sensors or other types of sensors, to measure the material pile size during calibration and throughout the paving process. Example systems may eliminate the manual adjustment of knobs for gains, and instead, auto-calibrate the pile size.

Prior designs required manual estimations and settings, i.e. a gain to be manually set for each job to create the target material pile size. Because the setting of these manual settings by the rotary switch requires some training and experience for consistency, there is a high probability that it will be incorrectly set at the beginning of paving job, resulting in inconsistent material height regulation when the gain is adjusted to the proper setting. Traditional pavers require close monitoring by the screed operator when paving commences until it is adjusted to the proper setting. Example systems of the present disclosure allow a paver to initialize with the proper gain and settings.

FIG. 1 shows an example paver 010. Tow arms 130, one located on each side of paver 010, pull the screed 100 and screed extender 110. An auger 300 is located in front of the screed 100.

Figure 2:
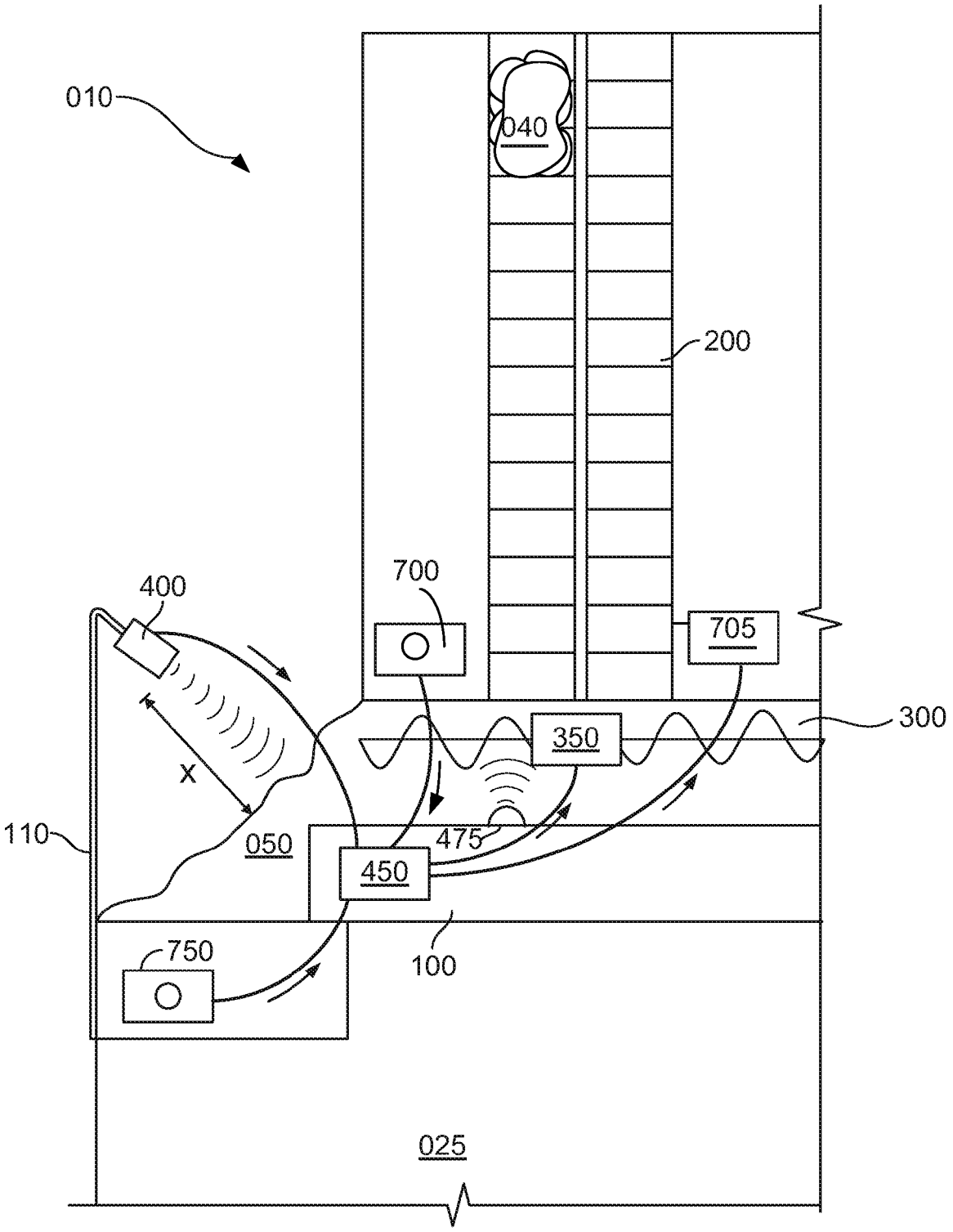
FIG. 2 is a schematic representation of an example system.

FIG. 2 depicts a schematic representation of an example system that includes an asphalt paving machine 010 of the type with which an example method may be implemented. It will be appreciated that the present disclosure may be useful for automatic calibration with other types of earth moving machines, and with similar machines that operate with a sensor as part of the machine control system.

Asphalt paver 010 includes rotatable conveyor 200, which feeds material 040 to rotatable auger 300. Auger 300 is adapted to receive asphalt 040 discharged from the conveyor 200 and spread asphalt 040 in front of screed 100 to form material volume 050, which the screed 100 compresses into laid asphalt road mat 025.

A sensor 400 is mounted on the screed extender 110, and while FIG. 2 only shows one sensor 400 at the end of screed extender 110, a second sensor may be mounted on the other end of screed extender 110. Sensor 400 should be adjusted to be pointed to a spot on pile 050 which should be maintained at a relatively constant height to create an even road mat 025. For example, a good spot to point sensor 400 would be just beyond the auger 300 edge. Operator station 700 and screed station 750 provide control over the paving process.

A second sensor 475 may be associated with paver 010. The second sensor 475 senses the amount of asphalt material 050 placed by conveyor 200 to the auger 300 and transmits corresponding signals in response to respective sensed excesses and deficiencies of asphalt material 040. Sensor 475 measures the material 050 in front of the auger 300 to vary the speed of the conveyor 200 to increase or decrease the material 040 delivered to auger 300. By using a second set of sensors 475 to detect the amount of material 040 delivered to the auger 300 by conveyor 200, the speeds of the auger 300 and the conveyor 200 can be independently adjusted. Without this sensor 475, it would be difficult to determine the independent conveyor 200 and auger 300 speed, and thus they could be tied together by an adjustable ratio. Thus, sensor 475 may replace a conveyor speed and auger speed ratio knob. Regardless, knobs on tractor control station 700 and screed control station 750 may still be retained for a manual setting or override of the target pile size calibration and application.

As paver 010 moves and pulls screed 100, sensor 400 transmits the material size information to ECM 450, which adjusts conveyor 200 and/or auger 300 speeds accordingly to ensure target pile size is maintained.

Figure 3:
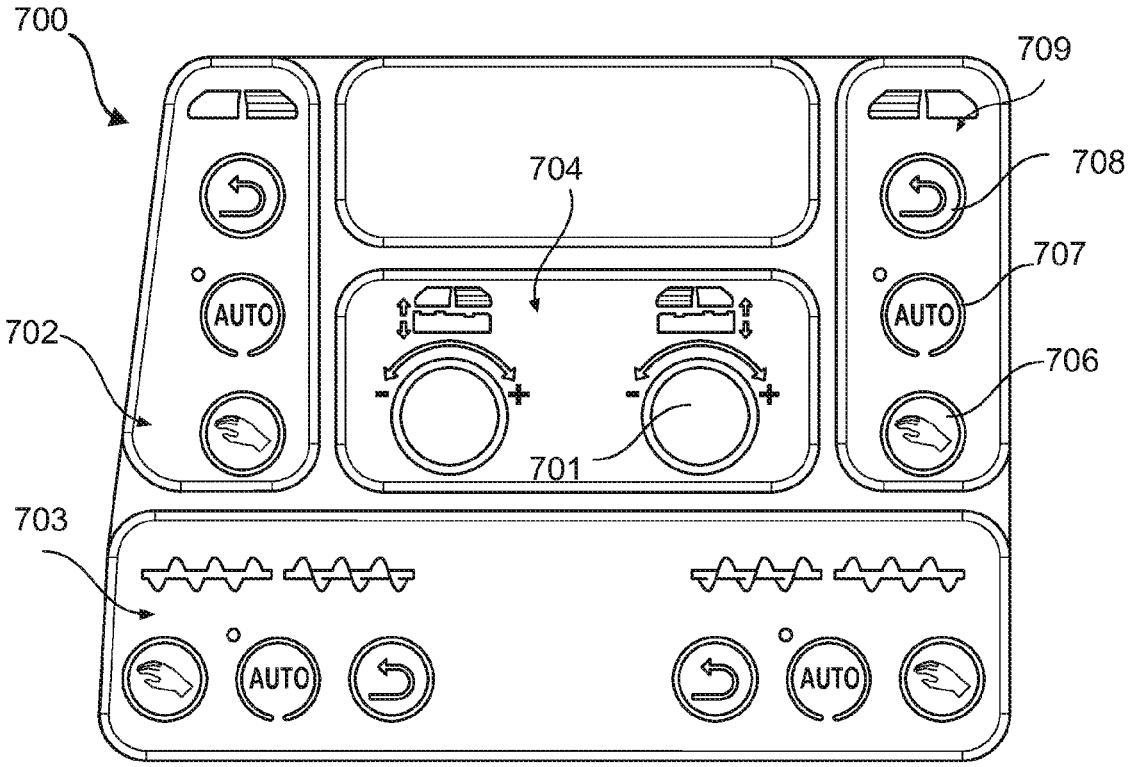
FIG. 3 shows an example operator control panel.

Referring to FIG. 3, an example tractor operator station 700 is shown. Operator station 700 is generally located on the tractor at the rear of the machine 010, and has independent controls for the conveyor 200 and the auger control 300. The left and right sides of station 700 perform the same functions for each respective side of the conveyor 200 and auger 300. For example, conveyor panel 709 controls the right side of conveyor 200 with reverse button 708, auto button 707, and manual override button 706. These buttons 706-708 operate in the same manner for left conveyor panel 702. Furthermore, buttons 706-708 operate in a similar manner for auger panel 703, including reverse, auto, and manual settings as indicated by the respective symbols. In one embodiment, the dials 701 on panel 704 are to adjust the target amount of material 040 the conveyor 200 delivers to the auger 300 when sensor 475 is employed. Panel 704 is used when button 707 on panel 709 or its corresponding button in panel 702 is activated to the "Automatic" or "Auto" mode. The left and right dials on panel 704 control the amount of material 040 delivered by the conveyor 200 to the auger 300. The manual buttons are "Manual Overrides" which momentarily activate the conveyors or augers at a fixed high speed.

In an alternate embodiment, the magnitude of the conveyor ratio signal may be adjusted by the relative position of the conveyor ratio dials 701 in panel 704. For example, "slow" or "–" represents a minimum speed ratio of the conveyor speed to the auger speed, while "fast" or "+" represents a maximum speed ratio of the conveyor speed to the auger speed. Thus, the conveyor speed may be calculated as a ratio of the auger speed. Left and right side of auger 300 may be controlled by left and right sides of panel 703.

Figure 4:
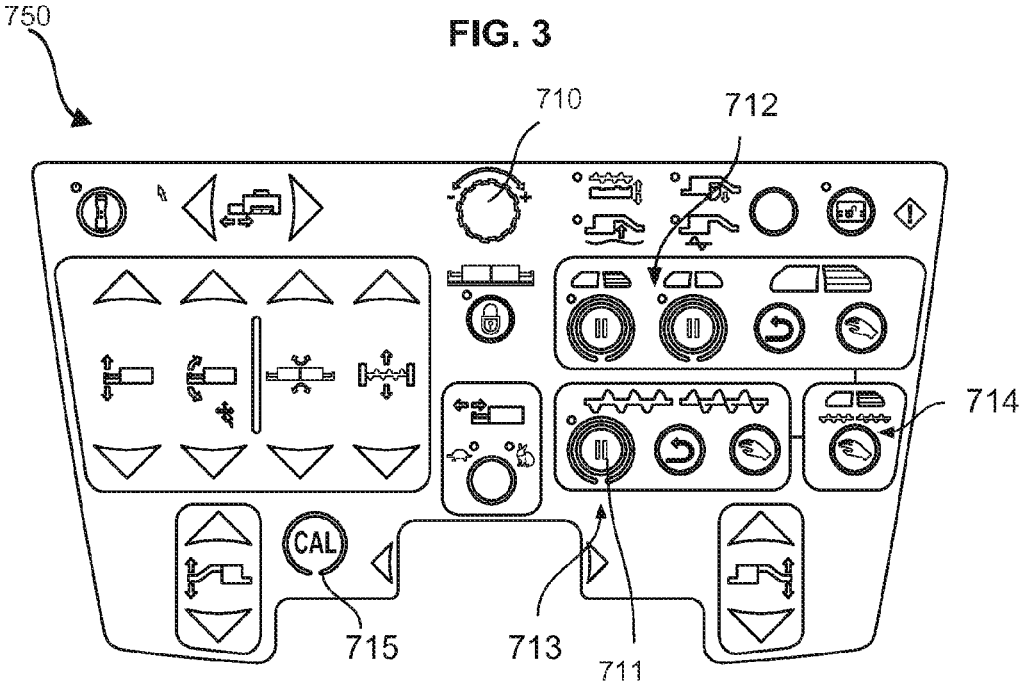
FIG. 4 shows an example screed station control panel, all arranged in accordance with at least some embodiments of the present disclosure.

Referring to FIG. 4, screed station 750 is located on the screed 100 of FIG. 2. A signal producing switch or button 715 initiates the program of calibrating the target material height at the edge of the screed 110. A material height dial 710 is turned to adjust the target height of material 050, at the edge of the screed 100. The material height dial 710 adjusts a signal indicative of a target amount of asphalt material 050 at the edge of the screed. The magnitude of the material height signal is adjusted by the relative direction and increments of the dial 710. For example, "low" or "–" represents a lesser amount of material, while "high" or "+" represents a greater amount of material 040 at the end of the screed.

In an alternate embodiment, a separate auto-calibrate button 715 may not be present. Upon starting the paver 010, the ECM's auto-calibrate function immediately senses the pile size 050, and sets the target height of material to be controlled by auger 300 and conveyor 200.

Conveyors 200 may be controlled by conveyor panel 712 and auger 300 may be controlled by auger panel 713, or conveyor 200 and auger 300 may be controlled simultaneously with panel 714, on the screed station 750. In addition to reverse and manual override buttons, screed station 750 panels 712 and 713 each have a pause button 711.

After setting up the prefill to a desired volume 050, as determined by calculation or experimentation, an operator initiates the disclosed method with auto button 707 or its corresponding button on left conveyor panel 702, on operator station 700, and then presses the Auto Calibrate button 715 on screed station 750. Sensor 400 continuously measures a distance x and send the distance information signal to an ECM 450. ECM 450 uses the distance (material height) information and paver 010 properties, and determines a conveyor 200 speed and an auger 300 speed to maintain that material height. The ECM 450 transmits this to the conveyor control 705 and auger control 350. When paver 010 is initiated to start paving, paver 010 commences at these determined speeds, or in an alternate embodiment, initializing the machine 010 automatically begins the calibration process, followed by paving.

Figure 5:
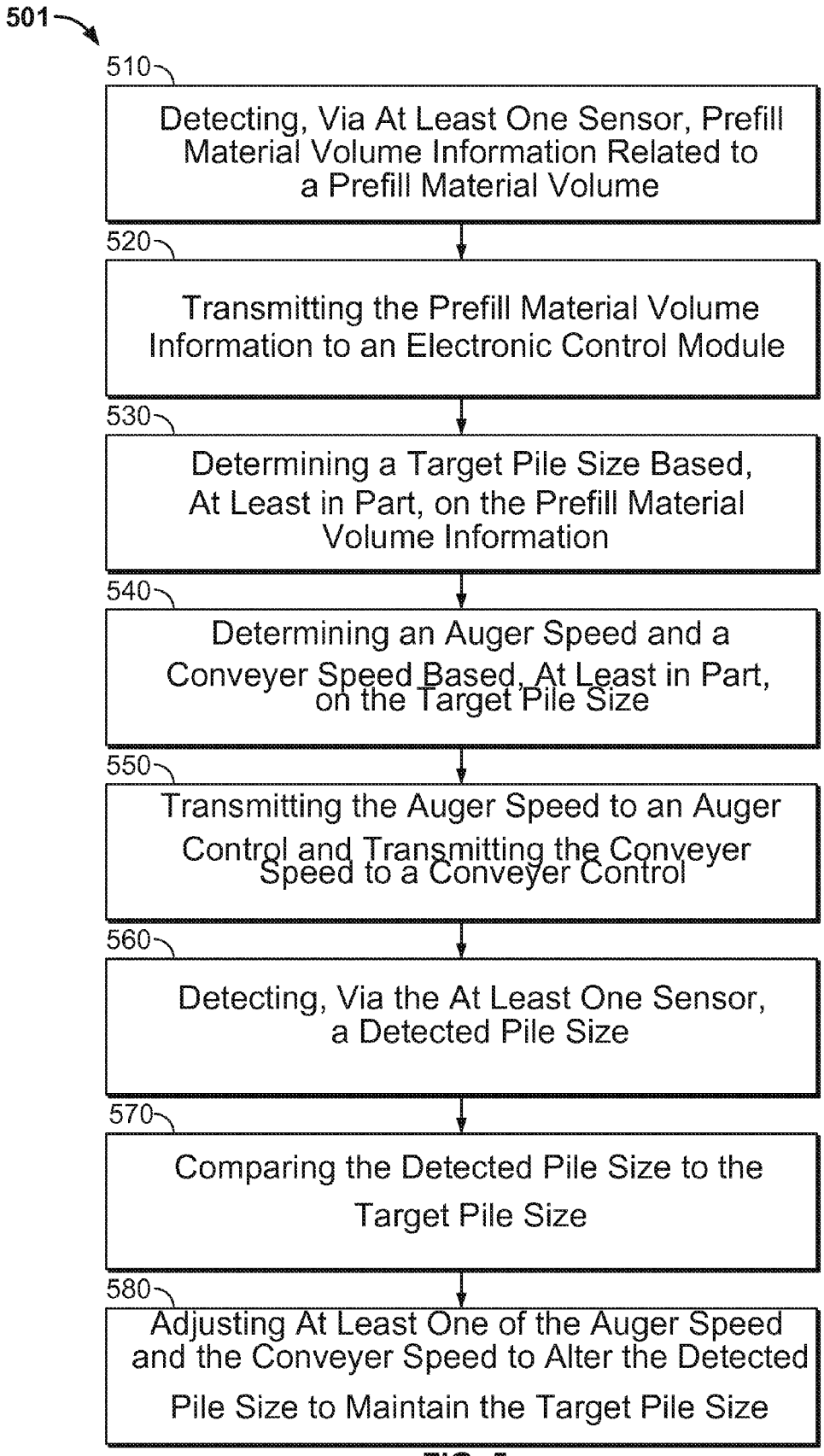
FIG. 5 is a flow chart, illustrating an example method of the present disclosure.

FIG. 5 is a flow chart outlining the method 501 of the disclosure. A prefill material volume 050 created in front of the screed 100 is measured with a sensor 400, as in operation 510. In operation 520, this material pile information is sent to the ECM 450, and set as a target pile size in operation 230. Before paving commences, in operation 540, the ECM 450 determines an auger and a conveyer speed, and in operation 550, transmits this information to the auger and conveyor controller. Upon starting the paver, the auger 300 and conveyor 200 turn at the determined speeds. During paving, as the conveyor and auger deposit material in front of the screed, the pile height varies and shifts. Thus the sensor periodically or continuously (e.g. seconds, or milliseconds, or any time interval) monitors the current pile size (i.e., detected pile size), and sends the information to the ECM, as in operation 560. In operation 570, the ECM compares the detected pile size to the target pile size, and transmits the appropriate signals to the conveyor and auger controls to adjust the conveyor and auger speeds, as in operation 580, to maintain the target pile size.

In an automatic mode, the ECM 450 increases the auger rotational speed in response to the actual material height being less than the target material height, i.e., the amount of asphalt material near the edge of the screed being below that of the target amount of material. This target material height is automatically determined by the sensor and the calibration program. Alternately, the control 450 reduces the auger rotational speed in response to the actual material height being greater than the target material height, i.e., the amount of asphalt material near the edge of the screed being greater than that of the target amount of material.

Industrial Applicability

This system may be used in asphalt pavers to reduce, minimize, and/or restrict operator variability. Example systems may allow an asphalt paver to accurately distribute material for the screed for the entire project.

The present system may be used when paving a road, parking lot, or other asphalt or aggregate surfaces. One advantage of the present disclosure lies in the commencing of the initial paving process; the operator does not have to guess an initial gain or auger and/or conveyor speed. The operator is not required to set a dial or guess the prefill material amount that the paver attempts to replicate; the paver measures a prefill material, and adjusts the auger and/or conveyor in response to the detected prefill material.

A prefill material pile size may be created in front of the screed, as typical in the industry. This prefill material to be created is determined before paver initialization, so the paver has a beginning frame of reference.

The prefill material pile volume is measured with a sensor and sent to the ECM, as a target pile size. As paving commences, the ECM determines an auger and a conveyer speed, and transmits this information to the auger and conveyor controller. Thus, upon starting the paver, the auger and conveyor turn at the appropriate speeds to deliver an accurate amount of feed material. During paving, the sensor periodically monitors the current pile size, and the ECM transmits the appropriate signals to the conveyor and auger controls to adjust the conveyor and auger speeds to maintain the target pile size.

The paver may be automated to reduce operator error, but retains manual override features.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An apparatus for regulating material feed for a paver having a screed, a conveyor, and an auger, the apparatus comprising:

a first sensor configured to detect a target pile size and a current pile size behind the screed;

a second sensor configured to detect a volume of a paving material delivered in front of the auger by the conveyor;

an electronic control module (ECM) configured to determine a rotational conveyor speed and a rotational auger speed to maintain the target pile size, based on the current pile size;

the ECM being configured to initiate on paver initializiation, and receive the current pile size input from the first sensor and the volume of a paving material delivered in front of the auger by the conveyor; and the ECM being configured to, upon activation, compare the current pile size to the target pile size, and to control the rotational conveyor speed based upon input from the second sensor and the rotational auger speed based upon input from the first sensor to maintain the target pile size.

2. A method for controlling a material feed system of a paver having a screed, the material feed system including a conveyor and an auger, the method comprising:

detecting, on paver initialization, by a first sensor, prefill material volume information related to a prefill material volume adjacent the screed;

detecting, on paver initialization, by a second sensor, information related to a volume of a paving material in front of the auger;

setting a target material volume based, at least in part, on the prefill material volume information;

determining a rotational auger speed based, at least in part, on the target material volume information and a conveyor speed based, at least in part, on the information related to the volume of paving material in front of the auger;

transmitting the rotational auger speed signal to an auger control and the conveyor speed to a conveyor control;

detecting a current material volume by the first sensor;

comparing the current material volume to the target material volume;

adjusting the auger speed to maintain the target pile size;

detecting a current volume of the paving material in front of the auger by the second sensor;

comparing the current volume of the paving material in front of the auger to a target volume of paving material in front of the auger; and adjusting the conveyor speed to maintain the target volume of paving material in front of the auger.

3. The method of claim 2, further including:

transmitting the prefill material volume information to an ECM; and wherein the step of setting the auger speed is set by the ECM according to the target material pile size.

4. The method of claim 2, wherein detecting the prefill material volume, and a current material volume, includes measuring a pile height.

5. The method of claim 4, wherein the pile height is determined by measuring a distance to the pile.

6. The method of claim 2, further including transmitting an auto-calibration signal prior to detecting the material pre-fill volume information.

7. The method of claim 2, further including:

detecting a current pile size at predetermined time intervals;

transmitting the current pile size information to an ECM; and controlling the rotational auger speed and the rotational conveyor speed to maintain the target pile size.

* * * * *

UNITED STATES PATENT AND TRADEMARK OFFICE

CERTIFICATE OF CORRECTION

PATENT NO. : 8,979,423 B2
APPLICATION NO. : 13/648952
DATED : March 17, 2015
INVENTOR(S) : Jameson Michael Smieja It is certified that error appears in the above-identified patent and that said Letters Patent is hereby corrected as shown below:

In the specification

Column 5, line 60, delete "Industrial Applicability" and insert -- INDUSTRIAL APPLICABILITY --.

In the claims

Column 6, line 43-44, In claim 1, delete "initializiation," and insert -- initialization, --.

Signed and Sealed this
Twenty-third Day of February, 2016

Michelle K. Lee

Michelle K. Lee
*Director of the United States Patent and Trademark Office*